US005452646A

United States Patent [19]

Fahnle

[11] Patent Number: 5,452,646

[45] Date of Patent: Sep. 26, 1995

[54] HYDROSTATIC MOTOR WITH AXIAL THRUST OFFSET

[75] Inventor: Gerhard Fahnle, Steinheim, Germany

[73] Assignee: J. M. Voith GmbH, Heidenheim, Germany

[21] Appl. No.: 199,161

[22] PCT Filed: Jun. 29, 1993

[86] PCT No.: PCT/EP93/01656

§ 371 Date: Jul. 8, 1994

§ 102(e) Date: Jul. 8, 1994

[87] PCT Pub. No.: WO94/01676

PCT Pub. Date: Jan. 20, 1994

[30] Foreign Application Priority Data

Jul. 2, 1992 [DE] Germany ..... 42 21 705.9

[51] Int. Cl.[6] ..... F01B 1/06

[52] U.S. Cl. ..... 91/492; 92/72

[58] Field of Search ..... 92/12.1, 73, 72; 91/492, 497, 498, 491

[56] References Cited

U.S. PATENT DOCUMENTS

| | | | |
|---|---|---|---|
| 3,044,412 | 5/1958 | Orshansky, Jr. . | |
| 3,187,681 | 6/1965 | Firth . | |
| 3,924,516 | 12/1975 | Nelson | 91/492 |
| 4,131,056 | 12/1978 | Rockwell | 91/492 |

FOREIGN PATENT DOCUMENTS

| | | | |
|---|---|---|---|
| 1907840 | 10/1970 | Germany . | |
| 2022846 | 11/1971 | Germany . | |
| 3021883 | 10/1981 | Germany . | |
| 599466 | 5/1978 | Switzerland . | |
| 8001092 | 5/1980 | WIPO | 91/492 |

*Primary Examiner*—Thomas E. Denion
*Attorney, Agent, or Firm*—Baker & Daniels

[57] ABSTRACT

A radial hydrostatic motor (radial piston machine) has a cylinder spider rotationally fixed and secured against axial displacement on a shaft and having a plurality of radial bores with pistons and sliding blocks that slide on the inner face of a hub ring or bushing. The bores communicate through control slots with high/low pressure delivery channels that open laterally into the cylinder spider in order to control the hydraulic media flow rate. Two mutually spaced rotors have bores with intercommunicating opposite control slots. Between both rotors is provided a housing intermediate partition having control disks opposite to the rotors and provided with channels which correspond to the control slots.

12 Claims, 3 Drawing Sheets

HYDROSTATIC MOTOR WITH AXIAL THRUST OFFSET

BACKGROUND OF THE INVENTION

The present invention concerns a radial piston hydrostatic motor having a cylinder spider on a shaft wherein the high and low pressure delivery channels extend from the piston bores laterally at the cylinder spider.

Such a single flow, so-called side-throw motor, is known from DE-OS 39 05 936. Provided in said motor are measures and means for absorbing and compensating for axial thrust forces acting on the cylinder spider (rotor) by way of the shaft. But it was evidenced that the axial forces are unfavorably large and that, moreover, the shaft is exposed on one side to the bending moment stemming from the radial forces, i.e., the shaft is stressed. Another problem is that the radial dimensions of the hydrostatic motor are relatively large for pumps with a large delivered volume.

The problem underlying the present invention consists in providing a hydrostatic motor of the type in which the axial (thrust) forces are, for the same delivered volume and conditions of flow, only half as large as in the prior hydrostatic motor and in which no bending moment, or at best only a minimal one, acts on the shaft.

SUMMARY OF THE INVENTION

This problem is solved by providing a cylinder spider that comprises two rotors mounted directly on the shaft with mutual spacing, the bores of the rotors having mutually communicating and mutually opposed control ports, wherein between the two rotors there is a housing partition and control discs having channels that coincide with the control ports and inlet and outlet channels in the partition.

The particular advantages of this design reside in the fact that the radial dimensions are relatively small and that a backing disk for absorption of the axial thrust forces is not needed. Overall, this provides a hydrostatic motor which, in view of its speed of rotation and efficiency as well as its stability and development of noise, constitutes a significant improvement over the prior art.

BRIEF DESCRIPTION OF THE DRAWINGS

Details of the hydrostatic motor will be more fully explained hereafter with the aid of the drawings, wherein.

DETAILED DESCRIPTION

Figure 1:
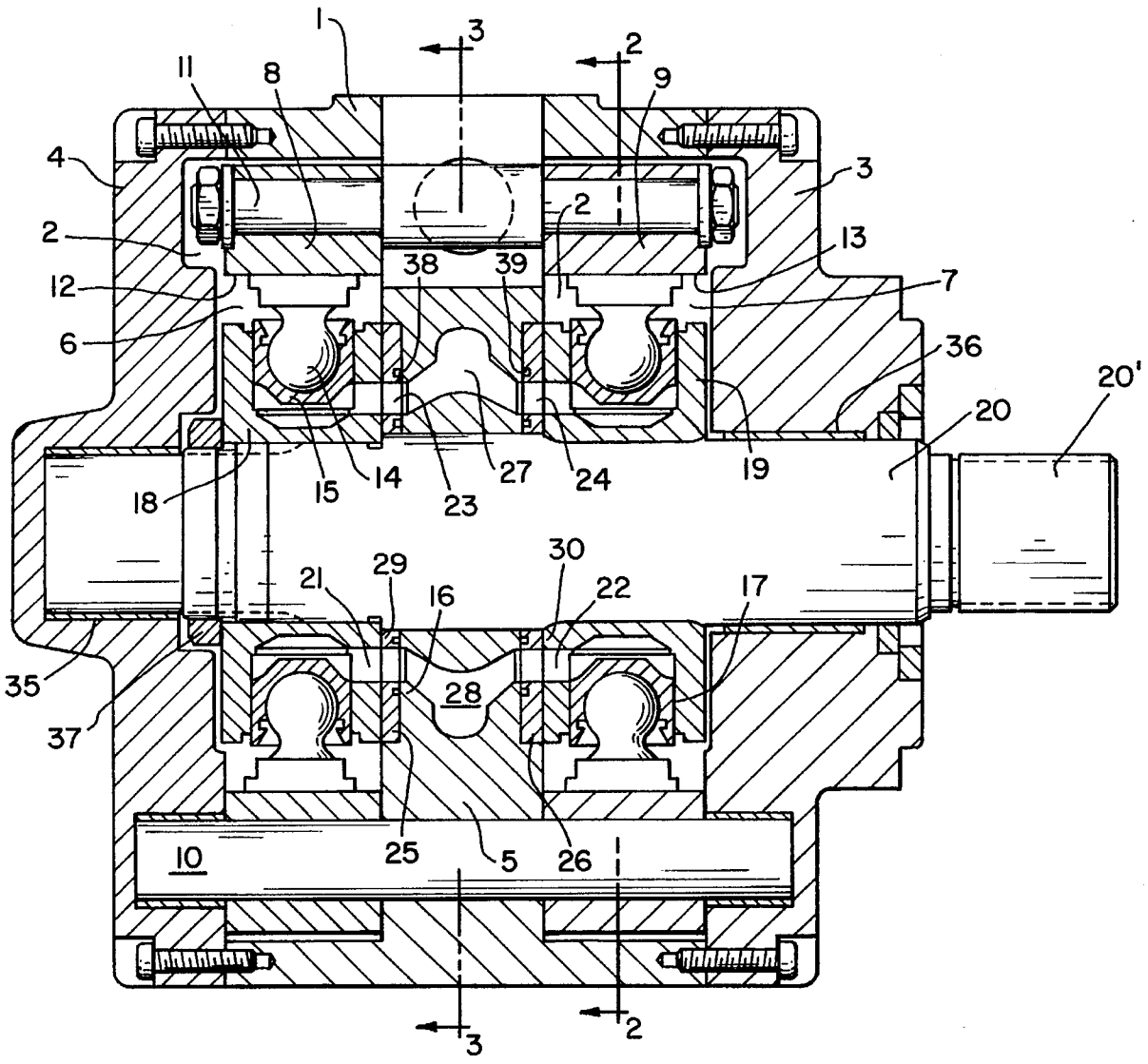
FIG. 1 is a longitudinal section of the hydrostatic motor.
Figure 2:
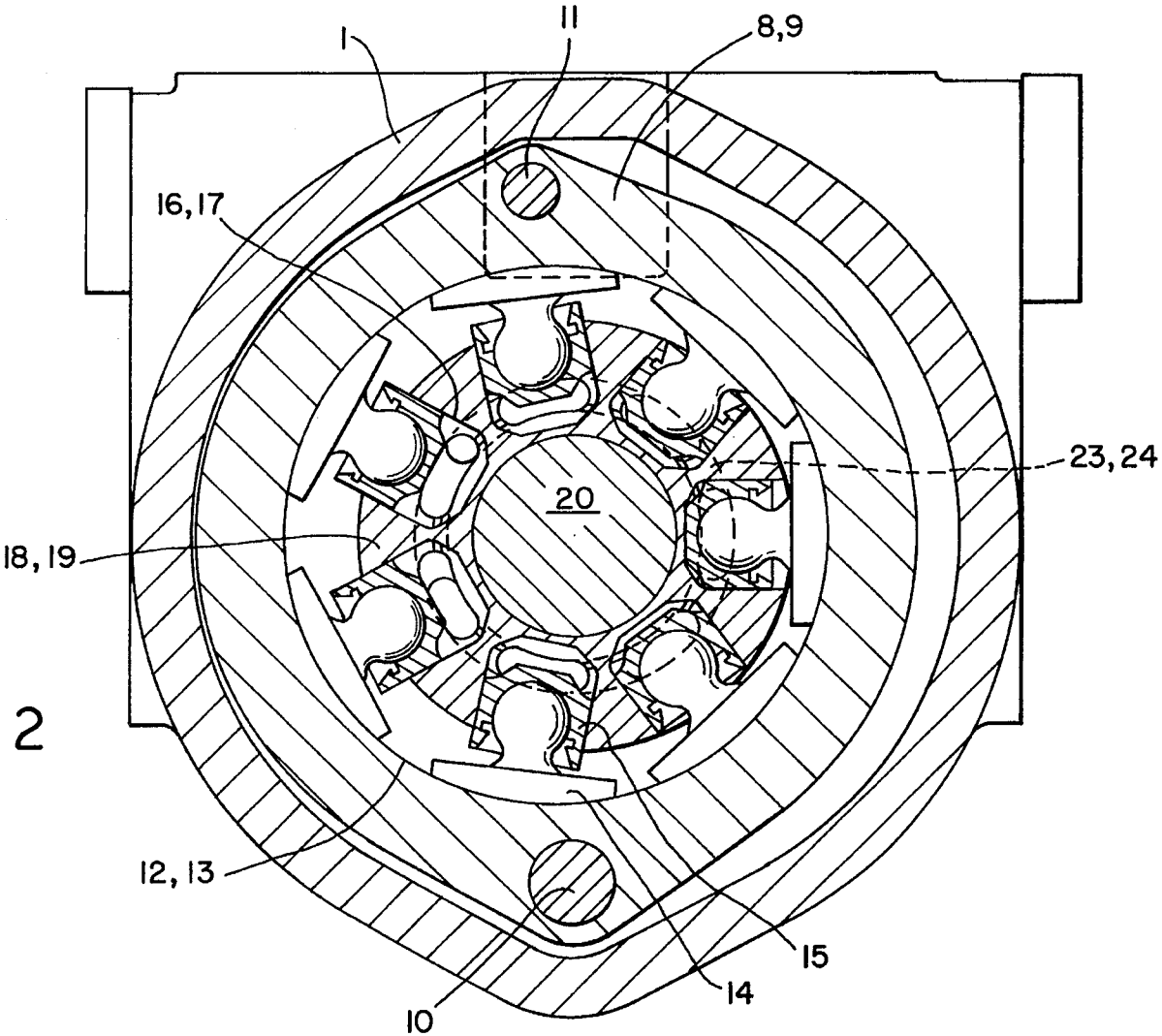
FIG. 2 is a cross section of the hydrostatic motor relative to FIG. 1 along line II—II.

The radial piston hydrostatic motor features a housing 1 with a cylindrical interior 2. The interior 2 is on both ends sealed by a cover 3, 4 and divided into two spaces 6, 7 of equal size by a circular partition 5 arranged axially centered relative to the cylindrical interior 2. Installed in the two spaces 6, 7 are bushings 8, 9, both of which are fixed jointly and relative to the housing covers 3, 4 by at least one connecting shaft 10 and bolts 11. Consisting of the functional linkage of a sliding shoe, or slider, 14 and a displacement piston 15 articulated to it, displacement elements serve the function of a hydrostatic motor or radial piston engine slide in a known fashion on the inner surfaces 12, 13 of bushings 8, 9. Pistons 15 are arranged in radial bores 16, 17 in rotors 18, 19 which form the cylinder spider and, in turn, are coupled in rotationally and axially fixed fashion to a shaft 20 driven by a drive union 20'.

The configuration described above—disregarding that nothing has been said as yet about the delivered flow or pumping function—matches the prior art insofar as rotors 18, 19 are known. The special design, however, resides in the hydrostatic motor's not being based on one rotor 18 or 19 but on two acting in synchronism with each other as a pumping unit, whereby ultimately, with identical dimensions, twice the pumping output is achievable.

In view of their function as a pumping element, rotors 18, 19 are in a mutually adapted manner coupled, or functionally joined, as follows: Facing one another, axial lateral control ports 21, 22 are provided in the radial bores 16, 17 of rotors 18, 19 so that bores 16, 17 are open toward partition 5. Control ports 21, 22 coincide with reniform (see FIG. 3) channels 23, 24 in control disks 25, 26 placed in appropriate recesses on both sides of partition 5. Coinciding with control ports 21, 22 and reniform channels 23, 24, connecting channels 27, 28 are transversely machined in the partition 5 itself, so that both rotors 18, 19 are by way of their displacement elements connected with each other—and able to jointly operate as a pump or hydrostatic motor. Created thereby is a two-flow hydrostatic motor, or radial piston engine, in which the connecting channels 27, 28 form the inlet/outlet channels and, consequently, are externally open.

The axial thrust created by the lateral pressure action upon pistons 15 and control ports 21, 22, due to the similar size of axial channels 23, 24 in control disks 25, 26 and due to the pressure fields 29, 30 enveloping these channels 23, 24 in the gaps between rotors 18, 19 and disks 25, 26, is thus offset by an opposite effect of the hydrostatic forces. The connection between rotors 18, 19 via shaft 20 thus avoids any axial application of force on the housing 1. Suitable installation and support of shaft 20 relative to housing covers 3, 4 (journals 35, 36 in housing covers 3, 4) allows total or nearly total bending moment offset. The axial flow of force and dual-flow piston arrangement—as compared to the single-flow piston engine—additionally yields a reduction in noise and size.

Figure 3:
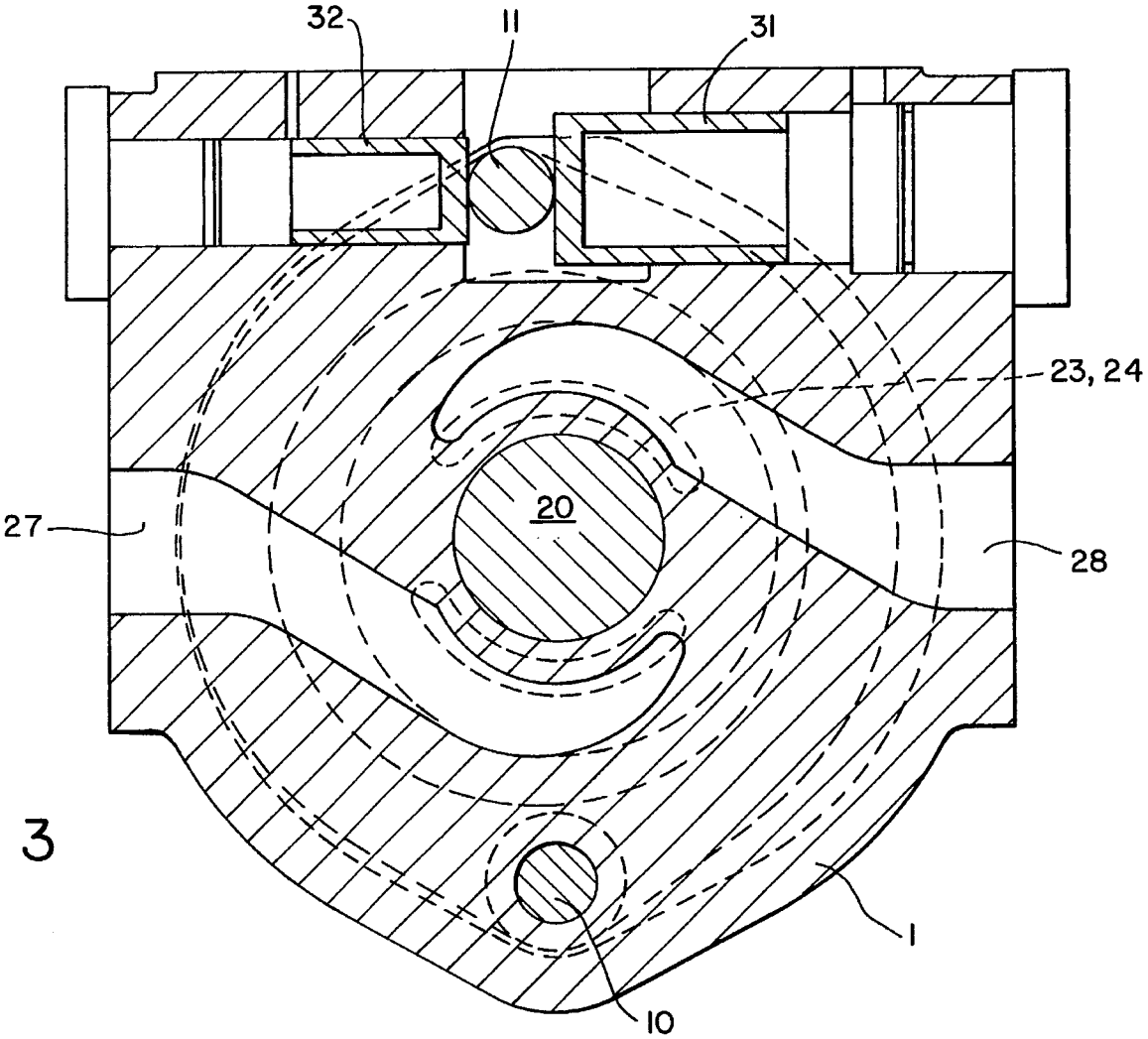
FIG. 3 is a cross section of the hydrostatic motor relative to FIG. 1 along line III—III.

Regarding the overall design configuration it is noted also that, with reference to FIG. 3, bushings 8, 9 are jointly positioned by means of an adjustment system consisting of an adjustment piston 31 and backing piston 32. This adjustment system is mounted to partition 5. Machined in partition 5 are the connecting channels 27, 28, i.e., the low-pressure inlet channel and the high-pressure outlet channel.

Rotors 18, 19, as mentioned already, are mounted on shaft 20 rotationally and axially fixed, with one rotor 19 integral with shaft 20, whereas the second rotor 18 is fixed by means of a barrel nut 37. As a special embodiment it is possible to fix the two rotors 18, 19 at a relative mutual offset by one-half pitch of the radially arranged pistons.

In summary, owing to the axial fixing of the two rotors 18, 19 on shaft 20, the axial forces need not be supported on the housing covers 3, 4. Furthermore, due to the axial forces caused by spacing of the reniform channels 23, 24 from the center axis of the shaft, a resultant torque is created which, at approximately equal magnitude, counteracts the bending moment generated by the pistons 15 on account of the pressure medium admission and their distance from the journals 35, 36 of shaft 20. For a reliable running of rotors 18, 19, the gap relative to the control disks 25, 26 should be kept minimally small, because of the leakage tightness depending on it. This is achieved by inserting in the control disks 25, 26, on the sides facing the partition 5, elastic seals, for example O-rings, which by delimiting the pressure fields 29, 30 generate against the respective rotor 18, 19 a force which by design is slightly greater than that generated by the pressure field distributed across the metallic seal on the rotor side of the control disks 25, 26. The gap between rotors 18, 19 and control disks 25, 26 is thereby kept very small.

I claim:

1. A radial piston hydrostatic motor comprising:

a shaft;

a cylinder spider disposed on said shaft including two axially spaced rotors fixedly mounted to said shaft and each having radially oriented bores with respective radially moveable pistons therein;

bushing means having a pair of inner surfaces;

a slide connected to each said piston, said slides being in slidable engagement with a respective said bushing inner surface;

said rotors including respective control ports in communication with respective said bores, each said control port opening in an axial direction and facing a said control port on the opposite, axially spaced rotor;

a housing enclosing said shaft and said cylinder spider, said housing including a partition disposed axially between said rotors;

a pair of control disks respectively disposed between said rotors and said partition and including channels aligned and in communication with certain ones of said control ports on the respective said rotor; and inlet and outlet channels in said partition aligned and in communication with each of said control channels.

2. The hydrostatic motor of claim 1 wherein said rotors are in respect of their bores mutually offset by one-half radial pitch.

3. The hydrostatic motor of claim 1 wherein said housing includes covers and wherein said bushing means comprises a pair of bushings that are fixed relative to each other through said housing covers.

4. The hydrostatic motor of claim 3 including an adjustment mechanism for moving said bushings, said adjustment mechanism supported by said partition.

5. The hydrostatic motor of claim 4 wherein said rotors are in respect of their bores mutually offset by one-half radial pitch.

6. The hydrostatic motor of claim 5 including seals disposed between each of said control discs and said partition, said seals surrounding said control disc channels for sealing the same.

7. The hydrostatic motor of claim 6 wherein one of said rotors is integral with said shaft and the other of said rotors is connected to said shaft.

8. The hydrostatic motor of claim 2 wherein one of said rotors is integral with said shaft and the other of said rotors is connected to said shaft.

9. The hydrostatic motor of claim 8 wherein said housing includes covers and wherein said bushing means comprises a pair of bushings that are fixed relative to each other through said housing covers.

10. The hydrostatic motor of claim 9 including an adjustment mechanism for moving said bushings, said adjustment mechanism supported by said partition.

11. The hydrostatic motor of claim 8 including seals disposed between each of said control discs and said partition, said seals surrounding said control disc channels for sealing the same.

12. The hydrostatic motor of claim 2 including seals disposed between each of said control discs and said partition, said seals surrounding said control disc channels for sealing the same.

* * * * *